US011188018B2

(12) United States Patent
Iwamoto et al.

(10) Patent No.: US 11,188,018 B2
(45) Date of Patent: Nov. 30, 2021

(54) MEDIUM TRANSPORT DEVICE AND IMAGE FORMING APPARATUS

(71) Applicant: FUJIFILM Business Innovation Corp., Tokyo (JP)

(72) Inventors: Kentaro Iwamoto, Kanagawa (JP); Kiyotoshi Kaneyama, Kanagawa (JP); Koichi Sato, Kanagawa (JP); Kaoru Matsushita, Kanagawa (JP); Hibiki Sasaki, Kanagawa (JP); Toshihiko Kamiyama, Kanagawa (JP); Mabumi Kashihara, Kanagawa (JP); Daisuke Tanaka, Kanagawa (JP); Takeshi Yasuda, Kanagawa (JP); Hiromoto Yamaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/924,188

(22) Filed: Jul. 9, 2020

(65) Prior Publication Data

US 2021/0302890 A1 Sep. 30, 2021

(51) Int. Cl.
*G03G 15/16* (2006.01)
*G03G 15/00* (2006.01)

(52) U.S. Cl.
CPC ..... *G03G 15/657* (2013.01); *G03G 15/162* (2013.01)

(58) Field of Classification Search
CPC . G03G 15/162; G03G 15/657; G03G 15/6558
See application file for complete search history.

(56) References Cited

U.S. PATENT DOCUMENTS 4,431,319 A * 2/1984 Karaki ..... B41J 2/24 101/93.05
8,571,453 B2 10/2013 Enomoto et al.
2004/0234304 A1* 11/2004 Tsuchiya ..... G03G 15/602 399/316
2016/0216653 A1* 7/2016 Yajima ..... G03G 15/205

FOREIGN PATENT DOCUMENTS

JP 2012103422 5/2012
JP 2019095571 6/2019

* cited by examiner

*Primary Examiner* — Sevan A Aydin
(74) *Attorney, Agent, or Firm* — JCIPRNET

(57) ABSTRACT

A medium transport device includes a transport member and a guide member. The transport member supports and transports a medium. The guide member is shifted from the transport member in a width direction of the medium to guide the medium. The guide member includes contact portions that come into contact with the medium. The contact portions are spaced apart from one another in a transport direction of the medium.

14 Claims, 7 Drawing Sheets

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2020-058854 filed Mar. 27, 2020.

BACKGROUND

(i) Technical Field

The present disclosure relates to a medium transport device and an image forming apparatus.

(ii) Related Art

An image forming apparatus such as a copying machine, a printer, and a FAX machine includes a medium transport device, which transports media such as paper sheets or OHP sheets. Technologies for such a medium transport device are described in Japanese Unexamined Patent Application Publication No. 2019-95571 and No. 2012-103422.

Japanese Unexamined Patent Application Publication No. 2019-95571 ([0040] to [0054] and FIGS. 1 to 9) describes a structure where an upstream guide (41) between a transfer belt (24) and a fixing device (30) includes a protrusion (44), which protrudes from a rear surface of a sheet (P) toward a straight course (R1) of the sheet (P). The technology described in Japanese Unexamined Patent Application Publication No. 2019-95571 allows the sheet (P) transported from the transfer belt (24) to move over the protrusion (44) without allowing the sheet (P) to be in contact with an introduction portion (43) upstream of the protrusion (44), and, upon arrival of the sheet (P) at a downstream guide (42), to transport the sheet (P) while bringing the sheet (P) in contact with the downstream guide (42) and the protrusion (44).

Japanese Unexamined Patent Application Publication No. 2012-103422 ([0022] to [0027] and FIG. 2) describes a structure where a rotation belt (81), which transports a sheet (P) while attracting the sheet (P) to a middle portion in a width direction, is disposed, and ribs (82a), extending in a transport direction, are disposed on the outer sides of the rotation belt (81) in the width direction to guide the sheet (P) with the ribs (82a).

SUMMARY

Aspects of non-limiting embodiments of the present disclosure relate to a simple structure achieving reduction of frictional charging or scratches on paper sheets while maintaining transportation performance, compared to a structure where a portion that comes into contact with a medium extends throughout in a width direction or a transport direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device that includes a transport member and a guide member. The transport member supports and transports a medium. The guide member is shifted from the transport member in a width direction of the medium to guide the medium. The guide member includes contact portions that come into contact with the medium. The contact portions are spaced apart from one another in a transport direction of the medium.

BRIEF DESCRIPTION OF THE DRAWINGS

Exemplary embodiments of the present disclosure will be described in detail based on the following figures, wherein:

FIG. 7A illustrates the modification example 1 and FIG. 7B illustrates the modification example 2;

FIG. 8A illustrates the modification example 3, and FIG. 8B illustrates the modification example 4; FIG. 9A illustrates the modification example 5, and FIG. 9B illustrates the modification example 6.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are omitted as appropriate for ease of understanding.

Example 1

Figure 1:
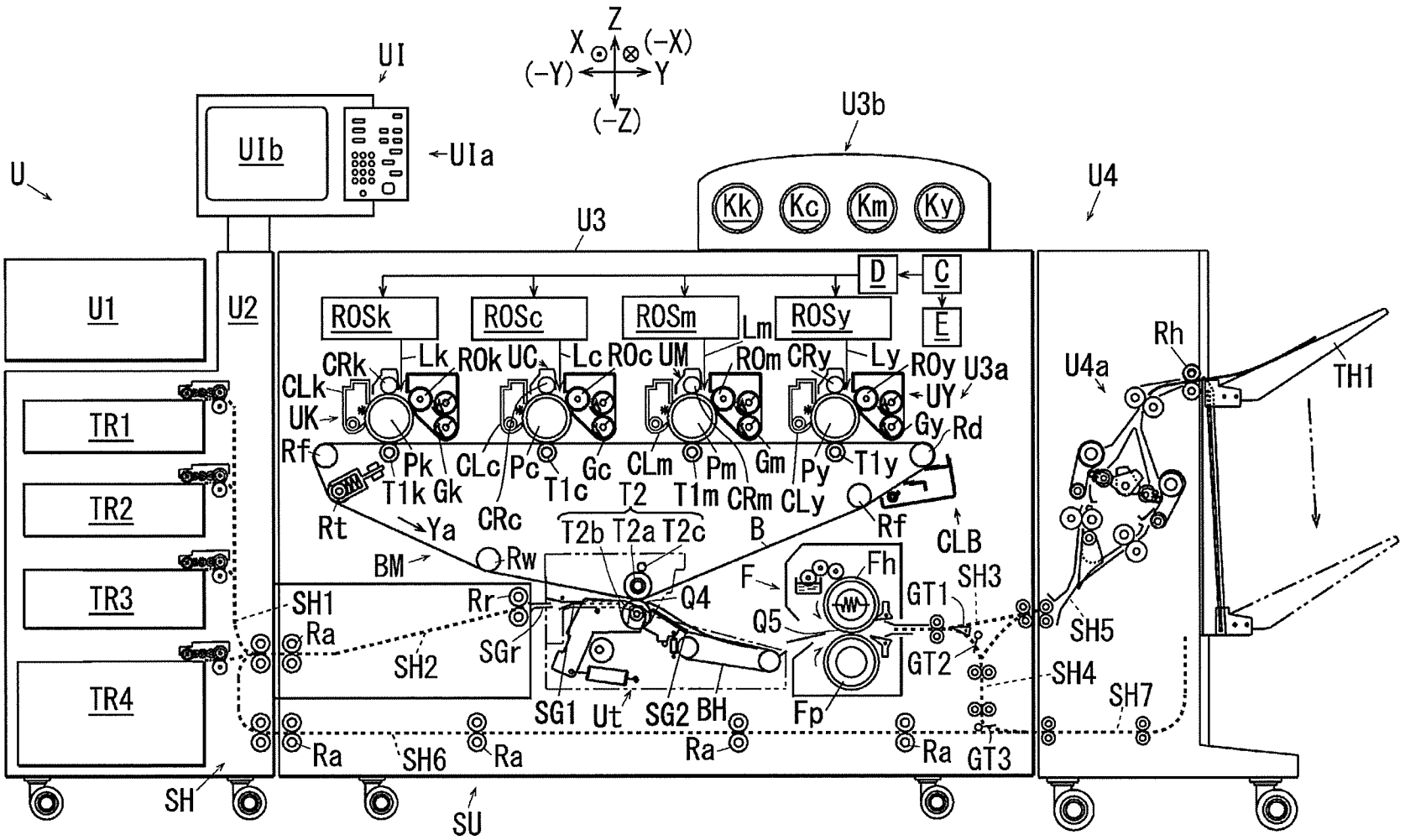
FIG. 1 illustrates the entirety of an image forming apparatus according to an example 1.

FIG. 1 illustrates the entirety of an image forming apparatus according to an example 1 of the present disclosure.

Figure 2:
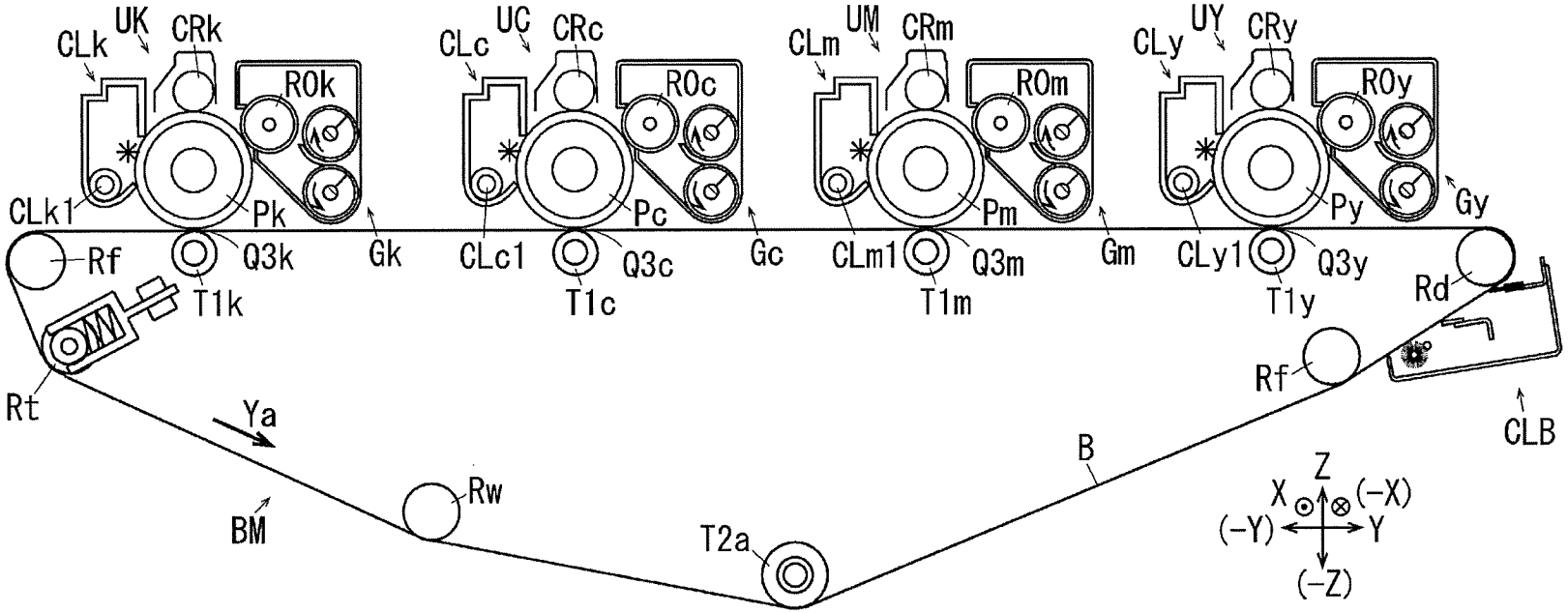
FIG. 2 is an enlarged view of a visible-image forming apparatus according to the example 1.

FIG. 2 is an enlarged view of a visible-image forming apparatus according to the example 1.

In FIG. 1, an image forming apparatus U, serving as an example of an image forming apparatus, includes a user interface UI, serving as an example of an operator, an scanning unit U1, serving as an example of an image reading unit, a feeder unit U2, serving as an example of a medium feeder, an image forming unit U3, serving as an example of an image recording device, and a medium processing device U4.

Description of User Interface UI

The user interface UI includes an input button UIa, used to start copying or determining the number of sheets to be copied. The user interface UI includes a display unit UIb, which displays the contents input through the input button UIa or the state of the copying machine U.

Description of Feeder Unit U2

In FIG. 1, the feeder unit U2 includes sheet feeding trays TR1, TR2, TR3, and TR4, serving as examples of a medium container. The feeder unit U2 also includes a medium feed path SH1. Along the medium feed path SH1, recording sheets S, which are accommodated in and picked up from the sheet feeding trays TR1 to TR4, are transported to the image forming unit U3. The recording sheets S are examples of media for image recording.

Description of Image Forming Unit U3 and Medium Processing Device U4

In FIG. 1, the image forming unit U3 includes an image recording unit U3*a*, which records images on the recording sheets S transported from the feeder unit U2 based on a document image read by the scanning unit U1.

In FIGS. 1 and 2, a driving circuit D of a latent-image forming device of the image forming unit U3 outputs driving signals corresponding to image information input from the scanning unit U1 to latent-image forming devices ROSy, ROSm, ROSc, and ROSk for the corresponding colors Y, M, C, and K at predetermined timing. Below the latent-image forming devices ROSy to ROSk, photoconductor drums Py, Pm, Pc, and Pk, which are examples of image carriers, are disposed.

The surfaces of the rotating photoconductor drums Py, Pm, Pc, and Pk are uniformly charged by charging rollers CRy, CRm, CRc, and CRk, which are examples of charging devices. The photoconductor drums Py to Pk having their surfaces charged allow electrostatic latent images to be formed on their surfaces by laser beams Ly, Lm, Lc, and Lk, serving as examples of latent-image writing light beams output by the latent-image forming devices ROSy, ROSm, ROSc, and ROSk. The electrostatic latent images on the surfaces of the photoconductor drums Py, Pm, Pc, and Pk are developed by developing devices Gy, Gm, Gc, and Gk into toner images of yellow Y, magenta M, cyan Y, and black K, which are examples of visible images.

The developing devices Gy to Gk receive an amount of developer corresponding to the amount consumed through development from toner cartridges Ky, Km, Kc, and Kk, which are examples of developer containers. The toner cartridges Ky, Km, Kc, and Kk are detachably attached to a developer dispenser U3*b*.

The toner images on the surfaces of the photoconductor drums Py, Pm, Pc, and Pk are sequentially superposed on and transferred to an intermediate transfer belt B, serving as an example of an intermediate transfer body, in first transfer areas Q3*y*, Q3*m*, Q3*c*, and Q3*k* by first transfer rollers T1*y*, T1*m*, T1*c*, and T1*k*, serving as examples of first transfer members, so that a color toner image, which is an example of a multicolor visible image, is formed on the intermediate transfer belt B. The color toner image formed on the intermediate transfer belt B is transported to a second transfer area Q4.

In the case of using only black image data, the photoconductor drum Pk and the developing device Gk for black K are only used to form only a toner image for the color K.

After first transfer, remnants such as remaining developer or paper dust adhering to the surfaces of the photoconductor drums Py, Pm, Pc, and Pk are removed by drum cleaners CLy, CLm, CLc, and CLk, which are examples of cleaners for image carriers.

In the example 1, the photoconductor drum Pk, the charging roller CRk, and the drum cleaner CLk are integrated into a photoconductor unit UK for the color K, which is an example of an image carrier unit. Similarly, for other colors Y, M, and C, the photoconductor drums Py, Pm, and Pc, the charging rollers CRy, CRm, and CRc, and the drum cleaners CLy, CLm, and CLc form photoconductor units UY, UM, and UC.

The photoconductor unit UK for the color K and the developing device Gk including the development roller R0*k*, which is an example of a developer holder, form a visible-image forming apparatus UK+Gk for the color K. Similarly, the photoconductor units UY, UM, and UC for the colors Y, M, and C and the developing devices Gy, Gm, and Gc including the development rollers R0*y*, R0*m*, and R0*c* form visible-image forming apparatuses UY+Gy, UM+Gm, and UC+Gc for the colors Y, M, and C.

A belt module BM, serving as an example of an intermediate transfer member, is disposed below the photoconductor drums Py to Pk. The belt module BM includes an intermediate transfer belt B, serving as an example of an image carrier member, a driving roller Rd, serving as an example of a member driving an intermediate transfer body, a tension roller Rt, serving as an example of a tensioning member, a walking roller Rw, serving as an example of a winding prevention member, multiple idler rollers Rf, serving as examples of driven members, a back-up roller T2*a*, serving as an example of an opposing member, and first transfer rollers T1*y*, T1*m*, T1*c*, and T1*k*. The intermediate transfer belt B is supported to be rotatable in the direction of arrow Ya.

A second transfer unit Ut is disposed below the back-up roller T2*a*. The second transfer unit Ut includes a second transfer roller T2*b*, serving as an example of a second transfer member. The area over which the second transfer roller T2*b* comes into contact with the intermediate transfer belt B forms a second transfer area Q4. The second transfer roller T2*b* is disposed on the side of the intermediate transfer belt B across from the back-up roller T2*a*, which is an example of an opposing member. A contract roller T2*c*, serving as an example of a power feeder, is in contact with the back-up roller T2*a*. The contract roller T2*c* receives a second transfer voltage having a polarity the same as that with which toner is charged.

The back-up roller T2*a*, the second transfer roller T2*b*, and the contract roller T2*c* form a second transfer device T2, serving as an example of a second transfer member.

A medium transport path SH2 is disposed below the belt module BM. The recording sheets S fed from the sheet feeding path SH1 of the feeder unit U2 are transported to registration rollers Rr, which are examples of members that adjust transport timing, by transport rollers Ra, serving as examples of medium transport members. The registration rollers Rr transport the recording sheets S downstream at the right timing when a toner image formed on the intermediate transfer belt B is transported to the second transfer area Q4. The recording sheet S transported by the registration rollers Rr is guided by a sheet guide SGr in front of the registration rollers and a sheet guide SG1 before transfer to a second transfer area Q4.

The toner image on the intermediate transfer belt B is transferred to the recording sheet S by the second transfer device T2 while passing the second transfer area Q4. In the case of forming a color toner image, toner images superposed on and first-transferred to the surface of the intermediate transfer belt B are collectively second-transferred to the recording sheet S.

The first transfer rollers T1*y* to T1*k*, the second transfer device T2, and the intermediate transfer belt B form a transfer device T1*y*–T1*k*+T2+B of the example 1.

The intermediate transfer belt B after the second transfer is cleaned by a belt cleaner CLB, serving as an example of an intermediate-transfer-body cleaner, disposed downstream of the second transfer area Q4. The belt cleaner CLB, serving as an example of a remover, removes remnants in the second transfer area Q4, such as paper dust or developer left without being transferred, from the intermediate transfer belt B.

The recording sheet S to which a toner image has been transferred is guided by a sheet guide SG2 after the transfer, and transported to a belt transport device BH, serving as an example of a medium transport device. The belt transport device BH transports the recording sheet S to a fixing device F.

The fixing device F includes a heating roller Fh, serving as an example of a heating member, and a pressing roller Fp, serving as an example of a pressing member. The recording sheet S is transported to a fixing area Q5, where the heating roller Fh and the pressing roller Fp are in contact with each other. While passing the fixing area Q5, the toner image on the recording sheet S is heated and pressed by the fixing device F to be fixed to the recording sheet S.

The visible-image forming apparatuses UY+Gy to UK+Gk, the transfer device T1*y*–T1*k*+T2+B, and the fixing device F form the image recording unit U3*a*, serving as an example of an image forming member of the example 1.

A switching gate GT1, serving as an example of a switching member, is disposed downstream of the fixing device F. The switching gate GT1 selectively switches a path for the recording sheet S passing the fixing area Q5, between a sheet discharge path SH3 and a sheet reverse path SH4 of the medium processing device U4. The recording sheet S transported to the sheet discharge path SH3 is transported to a medium transport path SH5 of the medium processing device U4. A curl correction member U4*a*, serving as an example of a warp correction member, is disposed on the medium transport path SH5. The curl correction member U4*a* corrects warpage, or so-called a curl of the recording sheet S transported thereto. The recording sheet S having its curl corrected is discharged to a discharge tray TH1, serving as an example of a medium discharge portion, with discharge rollers Rh, serving as examples of medium discharge members, while having its image fixed surface facing up.

The recording sheet S transported to the reversing path SH4 of the image forming unit U3 by the switching gate GT1 is transported through a second gate GT2, serving as an example of a switching member, to the reversing path SH4 of the image forming unit U3.

Here, when the recording sheet S is to be discharged while having its image fixed surface facing down, the transport direction of the recording sheet S is reversed after the trailing end of the recording sheet S in the transport direction passes the second gate GT2. Here, the second gate GT2 according to the example 1 is formed from a thin elastic member. Thus, the second gate GT2 allows the recording sheet S transported to the reversing path SH4 to pass therethrough once, and then guides the recording sheet S that has passed therethrough and then reversed or transported backward to the transport paths SH3 and SH5. The recording sheet S transported backward passes the curl correction member U4*a*, and is discharged to the discharge tray TH1 while having its image fixed surface facing down.

A circuit SH6 is connected to the reversing path SH4 of the image forming unit U3, and a third gate GT3, serving as an example of a switching member, is disposed at the connection portion. A downstream end of the reversing path SH4 is connected to a reversing path SH7 of the medium processing device U4.

The recording sheet S transported through the switching gate GT1 to the reversing path SH4 is allowed by the third gate GT3 to be transported to the reversing path SH7 of the medium processing device U4. As in the case of the second gate GT2, the third gate GT3 according to the example 1 is formed from a thin elastic member. Thus, the third gate GT3 allows the recording sheet S transported from the reversing path SH4 to pass therethrough once, and guides the recording sheet S that has passed therethrough and has been transported backward to the circuit SH6.

The recording sheet S transported to the circuit SH6 is transported again to the second transfer area Q4 through the medium transport path SH2 to have its second surface subjected to printing.

Components denoted with the reference signs SH1 to SH7 form the medium transport path SH. The components denoted with the reference signs SH, Ra, Rr, Rh, SGr, SG1, SG2, BH, and GT1 to GT3 form a sheet transport device SU according to the example 1.

Description of Medium Transport Device

Figure 3:
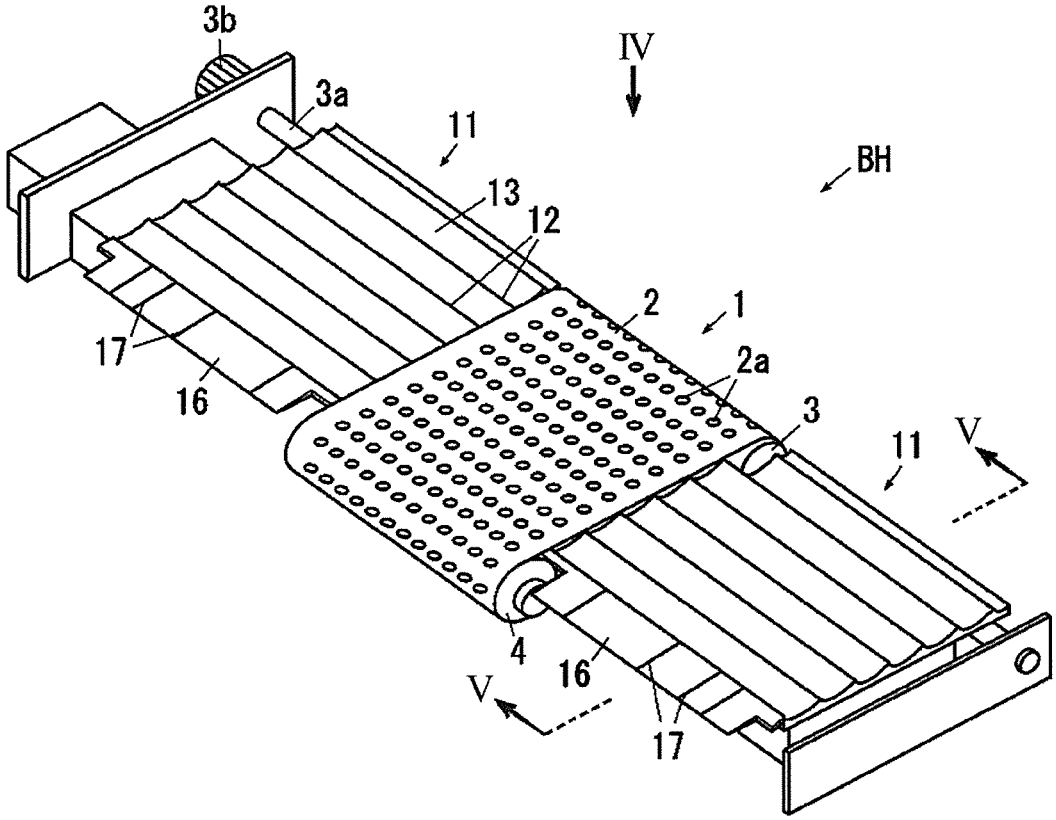
FIG. 3 is a perspective view of a medium transport device according to the example 1.

FIG. 3 is a perspective view of a medium transport device according to the example 1.

Figure 4:
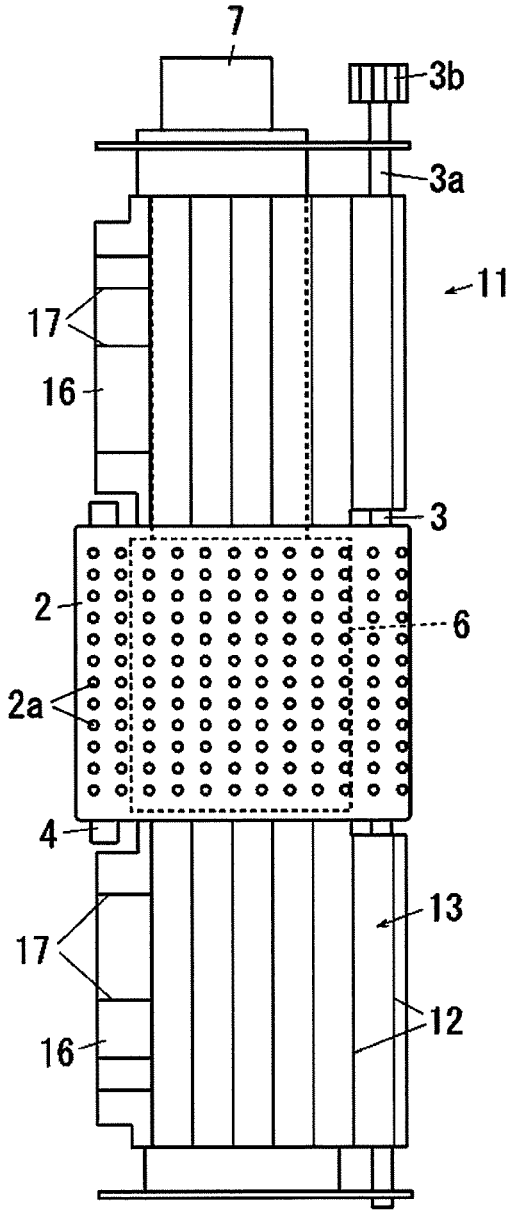
FIG. 4 is a view of the medium transport device, viewed in the direction of arrow IV in FIG. 3.

FIG. 4 is a view of the medium transport device, viewed in the direction of arrow IV in FIG. 3.

Figure 5:
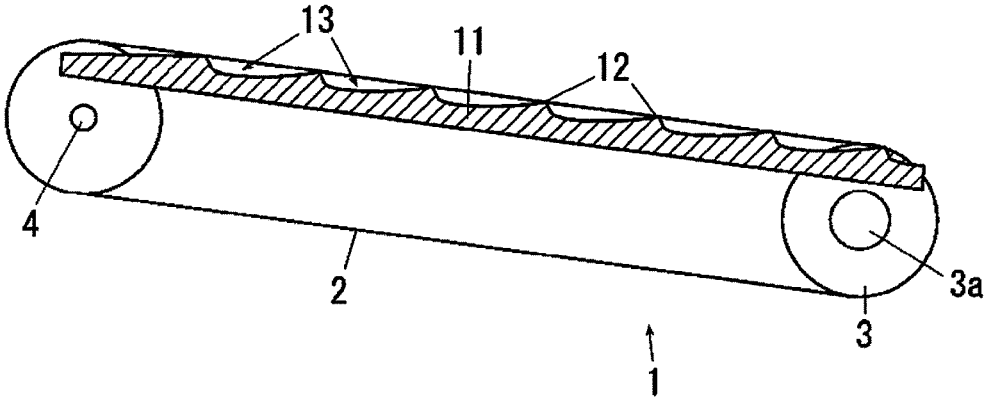
FIG. 5 is a cross-sectional view of the medium transport device, taken along line V-V in FIG. 3.

FIG. 5 is a cross-sectional view taken along line V-V in FIG. 3.

In FIGS. 3 to 5, the belt transport device BH according to the example 1 includes a transport belt 1, serving as an example of a transport member. The transport belt 1 is disposed at a middle in a front-rear direction, which is a width direction of the recording sheet S. The transport belt 1 includes an endless belt body 2, serving as an example of a transport member body and a belt-shaped member. The belt body 2 has multiple openings 2*a*.

The belt body 2 is supported while being stretched by a driving roller 3, serving as an example of a driving member, and a driven roller 4, serving as an example of a driven member. In the example 1, the driving roller 3 is disposed downstream and the driven roller 4 is disposed upstream in the transport direction of the recording sheet S. The driving roller 3 has its rotation shaft 3*a* extending rearward, and a gear 3*b*, serving as an example of a driving transmission member, is supported at the rear end of the rotation shaft 3*a*. Thus, when driving power from a driving power source, not illustrated, in the image forming unit U3 is transmitted to the gear 3*b*, the driving roller 3 rotates and the belt body 2 rotates.

A suction duct 6, serving as an example of an attraction member, is disposed in the belt body 2. A fan 7, serving as an example of a gas transfer member, is supported at the rear end portion of the suction duct 6. When the fan 7 operates, the suction duct 6 sucks air through openings 2*a* of the belt body 2. Thus, when the recording sheet S is placed on the upper surface of the belt body 2, the recording sheet S is attracted to the surface of the belt body 2.

Figure 6:
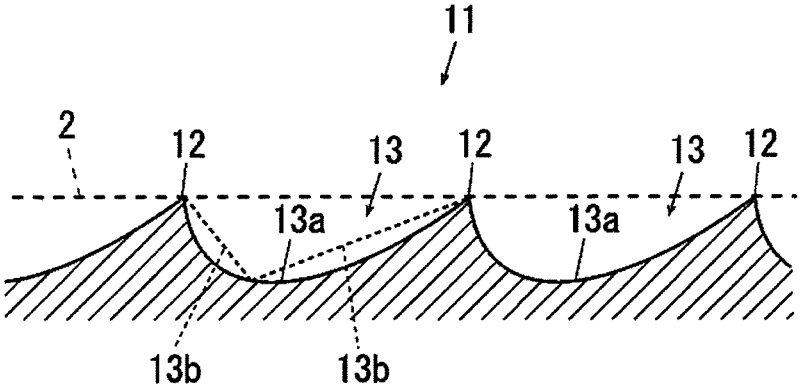
FIG. 6 illustrates a related portion of a guide member according to the example 1.

FIG. 6 illustrates a related portion of a guide member according to the example 1.

In FIGS. 3 to 5, ripple guides 11, serving as examples of guide members, are disposed on the outer sides of the belt body 2 in the width direction of the recording sheet S. Wave crests 12, serving as examples of contact portions, are formed on the upper surface of each ripple guide 11. The wave crests 12 are capable of guiding the recording sheet S while being in contact with the undersurface of the recording sheet S. The wave crests 12 according to the example 1 are arranged while being spaced apart from one another in the transport direction of the recording sheet S. The wave crests 12 extend in the front-rear direction, which is the width direction. In FIGS. 5 and 6, the top height of each wave crest 12 according to the example 1 is smaller than or equal to the height of the surface of the belt body 2. In other words, in the example 1, the top of each wave crest 12 does not protrude beyond the belt body 2.

In FIG. 6, each ripple guide 11 of the example 1 has troughs 13 each between adjacent two of the wave crests 12, in the transport direction of the recording sheet S. Each trough 13 has a slope shape with a height in the gravitational direction increasing toward the downstream side. Particularly, as illustrated in FIG. 6, in the example 1, each trough 13 has a slope protruding downward in the gravitational direction. Specifically, the trough 13 has a curved surface 13*a*, which is a curve protruding downward, instead of a flat slope 13*b* as indicated with a broken line in FIG. 6. Thus, the curved surface 13*a* of each trough 13 is hollowed downward below the flat slope 13*b* near the wave crests 12, and the top of each wavelength portion 12 is pointed. A gap between the wave crests 12 according to the example 1 in the transport direction is determined to be large enough to prevent a bent thin sheet with low rigidity from adhering to the trough 13.

In FIG. 3 to FIG. 5, introduction guides 16, serving as examples of second guide members, are disposed upstream of the ripple guides 11 in the transport direction of the recording sheet S. The introduction guides 16 are flat. Multiple protruding streaks 17 extending in the transport direction are disposed on the upper surfaces of the introduction guides 16. The protruding streaks 17 according to the example 1 are disposed at positions corresponding to the width of standard-size recording sheets S such as A4 or B5 sheets. The protruding streaks 17 are disposed on the slightly inner side of the standard-size width to guide the standard-size recording sheets S while being in contact with the lower surface at the ends in the width direction of the standard-size recording sheet S. The introduction guides 16 according to the example 1 guide the recording sheet S from the sheet guide SG2 after the transfer to the ripple guides 11, and have a length, in the transport direction, equivalent to one pitch between the wave crests 12.

Operation of Example 1

In the copying machine U according to the example 1 having the above structure, the recording sheet S to which an image has been transferred in the second transfer area Q4 is guided to the sheet guide SG2 after the transfer while having the image unfixed thereto, and transported to the belt transport device BH. The recording sheet S that has arrived at the belt transport device BH is attracted to the transport belt 1, and transported downstream to the fixing device F with rotation of the transport belt 1.

After the recording sheet S is guided by the introduction guides 16 on the outer sides of the transport belt 1 in the width direction, the recording sheet S is guided by the ripple guides 11. The ripple guides 11 guide the recording sheet S downstream while having portions around the tops of the wave crests 12 in contact with the portions of the recording sheet S not attracted to the transport belt 1.

Existing guide members, such as a structure described in Japanese Unexamined Patent Application Publication No. 2012-103422, usually include guide ribs, such as the protruding streaks 17 on the introduction guides 16, extending throughout in the transport direction to reduce the area over which they come into contact with a recording sheet S and to reduce transport resistance or frictional charging. In such a structure, however, the recording sheet S has the same portion in the width direction kept in contact with the guide rib while passing the guide ribs, so that only the contact portion significantly has frictional charging without the other portion having frictional charging. This may cause unevenness of charging, and disperse unfixed developer at the frictionally charged linear portion to cause linear image defects.

In the technology described in Japanese Unexamined Patent Application Publication No. 2019-95571, the protrusion (44) extending in the width direction instead of the transport direction guides a sheet (P) while being in contact with the undersurface of the sheet (P). However, in the structure described in Japanese Unexamined Patent Application Publication No. 2019-95571, the sheet (P) is supported at only one point of the protrusion (44). Thus, the contact pressure at the protrusion (44) rises, so that the amount of frictional charging may increase or scratches may occur.

Another conceivable structure is a structure including a transport belt extending throughout in the width direction without including the ripple guides 11 according to the example 1. However, this structure involves a belt having a uniform quality throughout the width direction of the belt, rollers (rollers corresponding to the driving roller 3 and the driven roller 4 according to the example 1) that stretch the belt and that are uniform in the axial direction, or attraction force uniform in the width direction. This structure has to have greater accuracy as the belt has a longer width. This structure thus increases manufacturing costs or involves additional components for securing the accuracy, and is more likely to be complexed. Wearing of the belt or the rollers over time never occurs uniformly throughout in the width direction, and a recording sheet is more likely to skew due to partial wearing. Thus, the belt extending throughout in the width direction is more likely to be affected by partial wearing, and more likely to degrade transportation performance (skewness).

On the other hand, in the ripple guide 11 according to the example 1, multiple wave crests 12 are arranged while being spaced apart from one another in the transport direction. This structure further reduces transport resistance and frictional charging than in the structure where the entire surface of the recording sheet S comes into contact with the guide, and further prevents unevenness in charging without a specific portion being kept in contact with the guide rib than in an existing structure where a guide rib extends in the transport direction. In this structure, the recording sheet S is supported by the multiple wave crests 12 in the transport direction. This structure thus disperses the contact pressure, reduces the amount of charging resulting from frictional charging, and reduces the occurrence of scratches, compared to the structure of Japanese Unexamined Patent Application Publication No. 2019-95571. Particularly, in the example 1, the wave crests 12 extend in the width direction instead of the transport direction, so that this structure prevents only a specific portion from coming into contact with the recording sheet in the width direction. In the example 1, the transport belt 1 does not extend throughout in the width direction, but the ripple guides 11 are disposed on both sides of the transport belt 1 to maintain the transportation performance while avoiding a complex structure.

In the ripple guides 11 according to the example 1, the height of the troughs 13 increases toward the downstream side. Thus, even when a recording sheet S has its leading end in contact with the troughs 13, the recording sheet S is guided toward the wave crests 12 by the surfaces of the troughs 13. Particularly, a thin sheet having its leading end easily bendable downward is more likely to be jammed or creased when the leading end collides against the surfaces or becomes caught between the wave crests 12. In contrast, the troughs 13 according to the example 1 prevent defects such as paper jamming.

In the example 1, each trough 13 has the curved surface 13*a* protruding downward, instead of the flat slope 13*b*. If the trough 13 has the flat slope 13*b*, a bent recording sheet S is more likely to come into contact with the trough 13 in front of the wave crests 12 over a larger area. This contact may degrade transport resistance or frictional charging. In contrast, compared to the flat slope 13*b*, the curved surface 13*a* protruding downward is spaced further apart from the upper surface of the transport belt 1, which substantially coincides with the track of the recording sheet S, and is less likely to come into contact with the recording sheet S in front of the wave crests 12. This structure thus prevents degradation of transport resistance or frictional charging.

In the example 1, the introduction guides 16 are disposed upstream of the ripple guides 11. In the structure not including the introduction guides 16, the leading end of the recording sheet S firstly reaches the trough 13, and a thin sheet having a leading end easily bendable downward may be jammed. In contrast, the structure of the example 1, which firstly guides the recording sheet S from the sheet guide SG2 after the transfer with the introduction guides 16, prevents jamming of the recording sheet S.

In the example 1, the height of the wave crests 12 is smaller than or equal to the height of the upper surface of the transport belt 1. In a structure where the height of the wave crests 12 is greater than the height of the upper surface of the transport belt 1, the recording sheet S attracted to the transport belt 1 is pressed against the wave crests 12 on the outer side in the width direction, and is more likely to receive a high contact pressure. In contrast, the example 1, where the height of the wave crests 12 is smaller than or equal to the height of the upper surface of the transport belt 1, prevents a rise of the contact pressure. This structure thus prevents a rise of the amount of frictional charging, scratches, or an increase of the transport resistance resulting from a high contact pressure.

In the example 1, the recording sheet S is transported while having a middle portion in the width direction attracted to the transport belt 1. The example 1 is thus capable of more stably transporting the recording sheet S to which an unfixed image has been transferred than the structure not including the transport belt 1, as in the structure described in Japanese Unexamined Patent Application Publication No. 2019-95571.

In the example 1, the ripple guides 11 are disposed on the outer sides of the transport belt 1. Although the ripple guide 11 may be disposed in the middle in the width direction and the transport belts 1 may be disposed on both outer sides in the width direction, the transport belts 1 disposed on both sides may operate at different speeds, and may cause the recording sheet S to skew. In contrast, as in the example 1, the structure including the transport belt 1 disposed in the middle in the width direction is less likely to cause the recording sheet S to skew and improves transport performance. Thus, the transport belt 1 is preferably disposed in the middle in the width direction.

Modification Examples 1 and 2

Figure 7A:
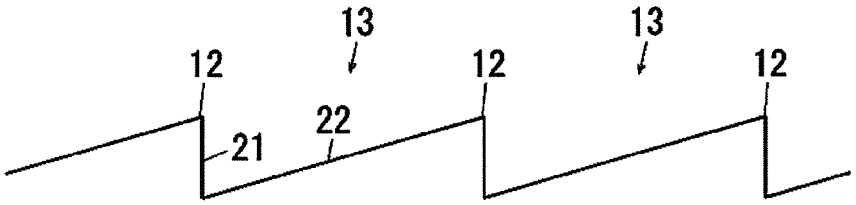
FIGS. 7A and 7B illustrate modification examples 1 and 2, where
Figure 7B:
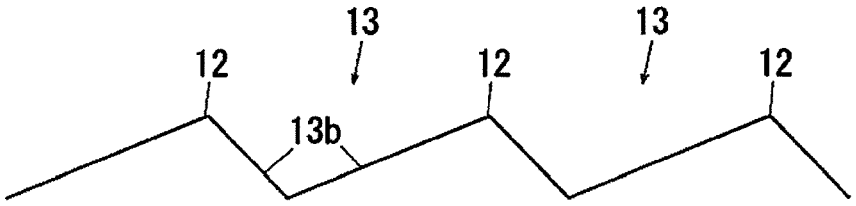

FIGS. 7A and 7B illustrate modification examples 1 and 2, where FIG. 7A illustrates the modification example 1 and FIG. 7B illustrates the modification example 2.

The example 1 is a case where the curved surface 13*a* of the trough 13 protrudes downward, but this is not the only possible structure. For example, as illustrated in FIG. 7A, a structure may include a vertical surface 21, extending downward in the gravitational direction, on the downstream side of the wave crests 12, and a slope 22, extending on the plane from the lower end of the vertical surface 21 to the subsequent wave crest 12.

As illustrated in FIG. 7B, the curved surface 13*a* may have a shape extending along the flat slope 13*b* illustrated in FIG. 6, which are virtual lines.

Modification Examples 3 to 6

Figure 8A:
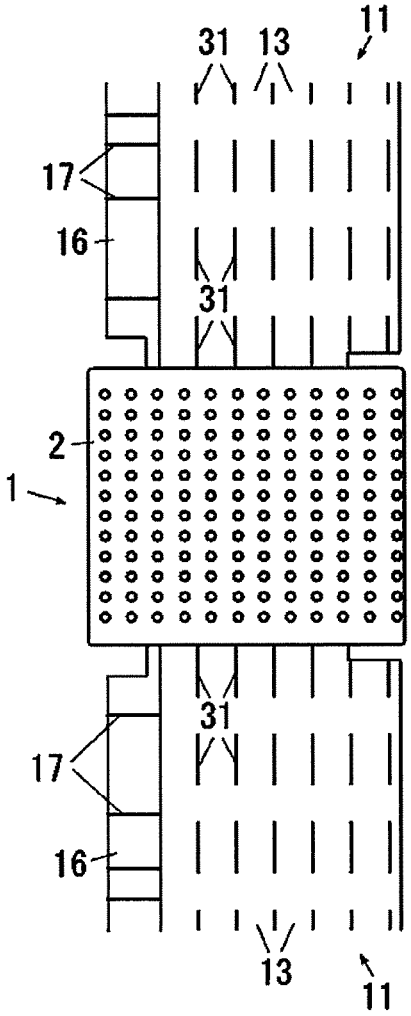
FIGS. 8A and 8B illustrate modification examples 3 and 4 of the example 1, where
Figure 8B:
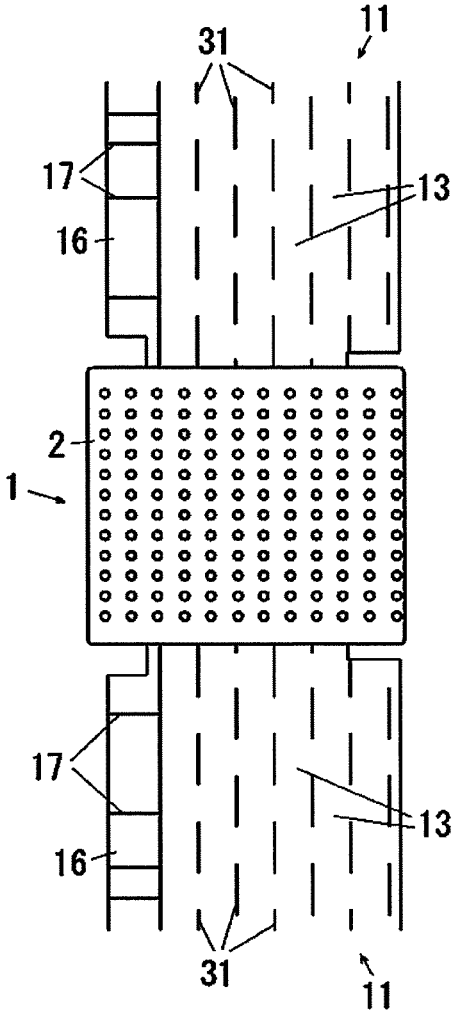

FIGS. 8A and 8B illustrate modification examples 3 and 4 of the example 1, where FIG. 8A illustrates the modification example 3, and FIG. 8B illustrates the modification example 4.

The example 1 is a case where the wave crests 12 extend in the width direction, but this is not the only possible structure. For example, as illustrated in FIGS. 8A and 8B, wave crests 31 may be spaced apart from one another also in the width direction. The wave crests 31 adjacent to each other in the transport direction may be disposed on the same position in the width direction, as illustrated in FIG. 8A, or different positions in the width direction, as illustrated in FIG. 8B. In the structures illustrated in FIGS. 8A and 8B, the contact area between the recording sheet S and the wave crests 31 is further reduced and frictional charging is further reduced than in the case of the example 1. In the structure illustrated in FIG. 8B, the recording sheet S and the wave crests 31 come into contact with each other fewer times at the same contact positions in the width direction. Thus, this structure further reduces frictional charging than in the structure illustrated in FIG. 8A.

Figure 9A:
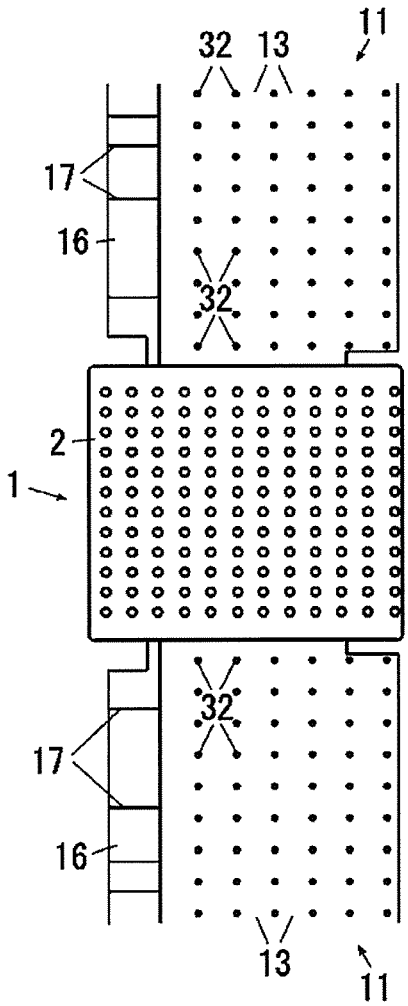
FIGS. 9A and 9B illustrate modification examples 5 and 6 of the example 1, where
Figure 9B:
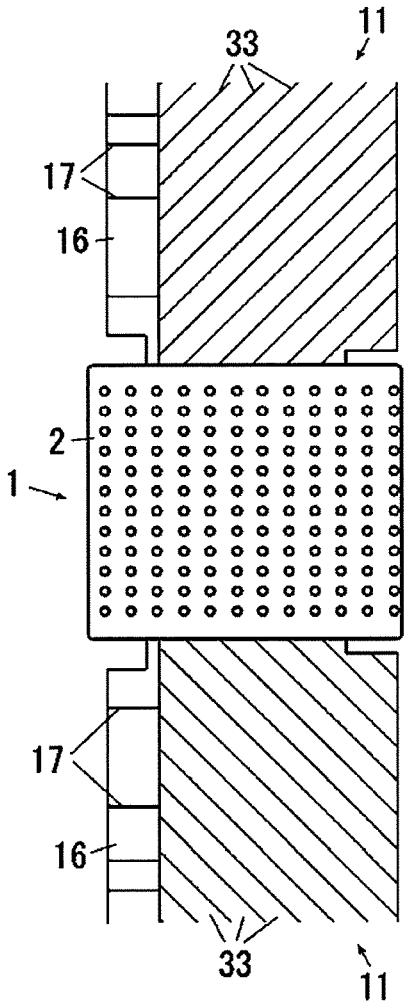

FIGS. 9A and 9B illustrate modification examples 5 and 6 of the example 1, where FIG. 9A illustrates the modification example 5, and FIG. 9B illustrates the modification example 6.

As illustrated in FIG. 9A, instead of a structure where the top of each wave crest 32 extends in the width direction, the top may be a dot form. Specifically, the wave crests 32 may be spaced apart from one another in the width direction and the transport direction. The structure illustrated in FIG. 9A further reduces the contact area, and reduces frictional charging.

In addition, as illustrated in FIG. 9B, wave crests 33 may be inclined with respect to the width direction and the transport direction. This structure also prevents the wave crests 33 from being continuously in contact with the recording sheet at the same position in the width direction, compared to the case of the guide ribs, and prevents a specific portion from being frictionally charged. Particularly, in the structure illustrated in FIG. 9B, the wave crest 33 is further inclined outward in the width direction as it extends downstream in the transport direction. Thus, the recording sheet S that comes into contact with the wave crests 33 receives a force of expanding outward in the width direction as it moves further downstream. Thus, a force of expanding the recording sheet S is exerted on the recording sheet S. This structure thus prevents the recording sheet S from being creased compared to the structure other than the structure of FIG. 9B.

Modified Examples

Thus far, the examples of the present disclosure have been descried in detail. However, the disclosure is not limited to the above-described examples, and may be modified in various manners within the scope of the gist of the present disclosure described in the scope of claims. Modified examples H01 to H06 of the present disclosure are described, below, by way of examples.

H01

In the above examples, a copying machine U is described as an example of an image forming apparatus, but the present disclosure is not limited to this. The present disclosure is applicable to, for example, a FAX machine, or a multifunctional device including multiple functions such as a FAX machine, a printer, and a copying machine. The image forming apparatus is not limited to a multi-color image forming apparatus, and may be a monochrome image forming apparatus.

H02

In the above example, specific numbers described by way of example are changeable as appropriate depending on changes of design or specifications. For example, instead of the examples described above by way of examples, the number of wave crests or the gap between the wave crests may be changed in accordance of the purpose of use.

H03

In the above example, the example 1 and the modification examples 1 to 6 may be combined with one another. For example, the modification example 1 and modification example 6 may be combined with each other.

H04

In the above example, the introduction guides 16 are preferably disposed, but may be omitted.

H05

In the above example, the transport belt 1 is described as an example of a transport member, but the present disclosure is not limited to this. A roller-shaped transport member may be used, instead. The transport belt 1 preferably has a structure of attracting the recording sheet S, but may not have the attracting function.

H06

In the above example, the height of the wave crests is preferably smaller than or equal to the height of the transport belt 1, but not limited to this. The height of the wave crest may be higher than the transport belt 1 within the range in which the contact pressure is allowed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device, comprising:

a transport member that supports and transports a medium, wherein the medium is a recording sheet; and a guide member that is shifted from the transport member in a width direction of the medium to guide the medium, the guide member including contact portions that come into contact with the medium, the contact portions being spaced apart from one another in a transport direction of the medium through a plurality of troughs disposed therebetween, wherein each of the plurality of troughs between the contact portions in the transport direction of the medium has a curved sloped surface, wherein the entire curved sloped surface asymmetrically concaves downward from an interface between the contact portions and the medium.

2. The medium transport device according to claim 1, wherein the guide member is disposed on an outer side of the transport member in the width direction.

3. The medium transport device according to claim 2, further comprising:

a second guide member that is disposed upstream of the guide member in the transport direction of the medium to guide the medium, the second guide member including a protruding streak extending in the transport direction of the medium.

4. The medium transport device according to claim 1, wherein the each of the plurality of troughs has the curved sloped surface concaving downward in a gravitational direction.

5. The medium transport device according to claim 4, further comprising:

a second guide member that is disposed upstream of the guide member in the transport direction of the medium to guide the medium, the second guide member including a protruding streak extending in the transport direction of the medium.

6. The medium transport device according to claim 1, further comprising:

a second guide member that is disposed upstream of the guide member in the transport direction of the medium to guide the medium, the second guide member including a protruding streak extending in the transport direction of the medium.

7. The medium transport device according to claim 1, wherein a height of a top of each of the contact portions is smaller than or equal to a height of the transport member supporting the medium.

8. The medium transport device according to claim 1, wherein the transport member includes an endless belt member that rotates while supporting the medium on a surface thereof, and an attracting member that attracts the medium to the belt member.

9. The medium transport device according to claim 1, wherein the contact portions each have at least one protrusion extending in the width direction of the medium.

10. The medium transport device according to claim 9, wherein the at least one protrusion of each of the contact portions includes a plurality of protrusions spaced apart from one another in the width direction of the medium.

11. The medium transport device according to claim 10, wherein the protrusion of each of the contact portions is inclined downstream in the transport direction as the protrusion extends further outward in the width direction.

12. The medium transport device according to claim 9, wherein the protrusion of each of the contact portions is inclined downstream in the transport direction as the protrusion extends further outward in the width direction.

13. The medium transport device according to claim 1, wherein the contact portions are arranged while being spaced apart from one another in the transport direction and the width direction of the medium.

14. An image forming apparatus, comprising:

an image carrier member;

a transfer member that transfers an image on a surface of the image carrier member to a medium;

the medium transport device according to claim 1 that transports the medium to which the image is transferred; and a fixing device that fixes the image on the medium transported by the medium transport device to the medium.

* * * * *